United States Patent [19]

Rojko et al.

[11] Patent Number: 4,902,283

[45] Date of Patent: Feb. 20, 1990

[54] ABSORBABLE CLEANING MITT FOR WIPING BABIES

[75] Inventors: Josef Rojko; Maria Rojko, both of Lienz, Austria; Norbert Leopoldi, Chicago; Roy A. Weidemann, Lake Bluff, both of Ill.

[73] Assignee: L.R.W. Enterprises, Inc., Chicago, Ill.

[21] Appl. No.: 258,686

[22] Filed: Oct. 17, 1988

Related U.S. Application Data

[63] Continuation-in-part of Ser. No. 193,259, May 11, 1988, and a continuation-in-part of Ser. No. 224,431, Jul. 26, 1988.

[51] Int. Cl.[4] ..... A61M 35/00

[52] U.S. Cl. ..... 604/290; 15/227; 294/1.3; 2/167; 604/292

[58] Field of Search ..... 604/290, 292, 385.1; 294/1.3; 2/20, 164, 167; 15/227

[56] References Cited

U.S. PATENT DOCUMENTS

| | | | |
|---|---|---|---|
| 2,782,912 | 2/1957 | Hunphrey . | |
| 4,065,826 | 1/1978 | Hough | 15/227 |
| 4,347,931 | 9/1982 | Ginger et al. | 206/438 |
| 4,645,251 | 2/1987 | Jacobs | 294/1.3 |
| 4,677,697 | 7/1987 | Hayes | 2/159 |
| 4,741,565 | 5/1988 | Bagg | 294/1.3 |
| 4,788,733 | 12/1988 | Lerner | 15/104.94 |

FOREIGN PATENT DOCUMENTS

| | | | |
|---|---|---|---|
| 2566631 | 1/1986 | France | 604/385.1 |
| 2033731 | 5/1980 | United Kingdom . | |
| 1583181 | 1/1981 | United Kingdom . | |
| 2134371 | 8/1984 | United Kingdom . | |

*Primary Examiner*—C. Fred Rosenbaum
*Assistant Examiner*—Mark O. Polatta
*Attorney, Agent, or Firm*—Milton S. Gerstein

[57] ABSTRACT

A baby-wipe for wiping and cleaning babies. Two inner, water-repellent layers define a hollow interior for the insertion of a hand. Two outer, cotton, absorbing layers are used to wipe a baby clean, with the inner water-repellent layers preventing the user's hand from becoming wet or soiled by waste product. After wiping the baby, the product is everted so that the inner layers now become the outer layers in order to form a disposable waste-product bag that may be thrown away in a garbabe can, whereby the user is never soiled and never directly contacts the waste product.

16 Claims, 6 Drawing Sheets

FIG. 14
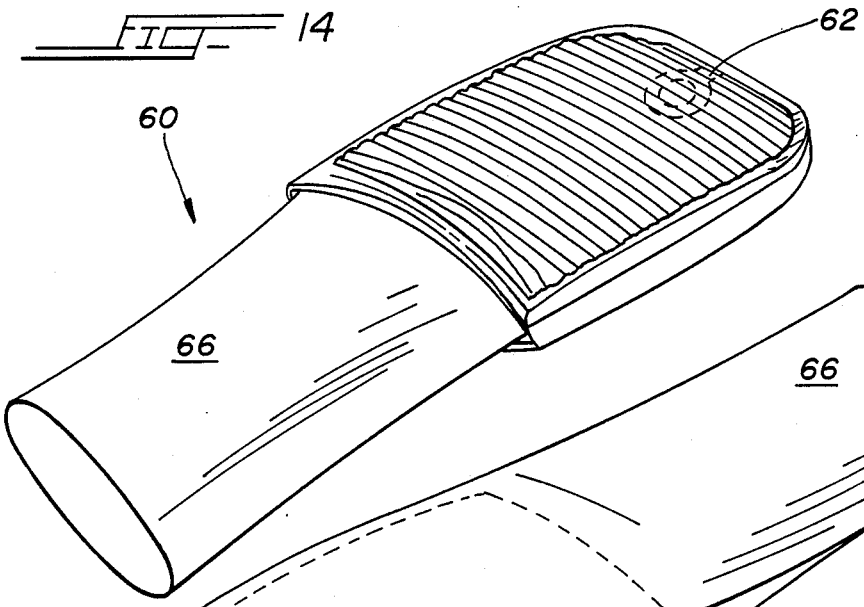
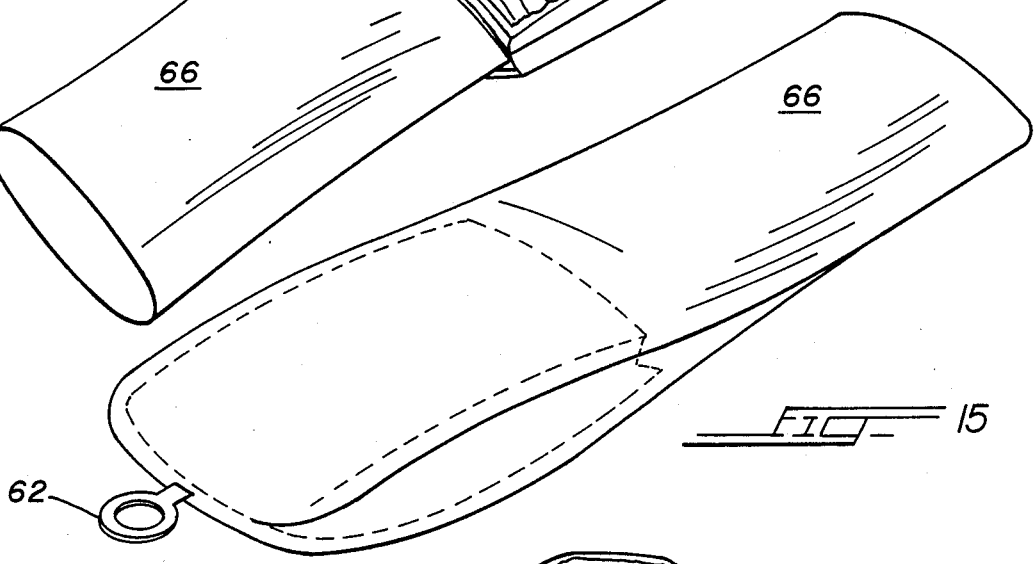
FIG. 15
FIG. 16
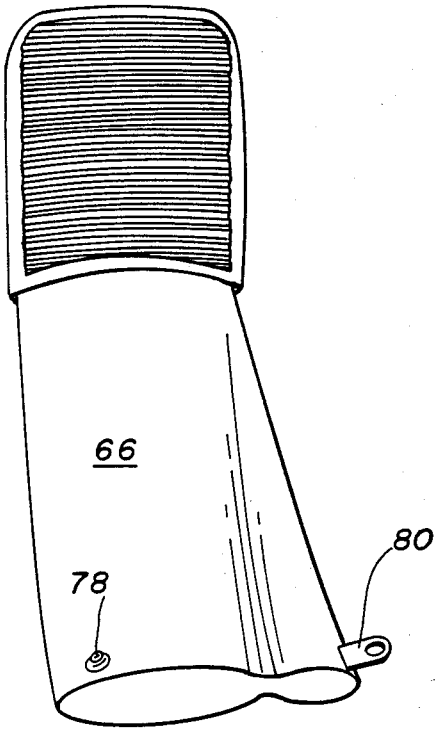
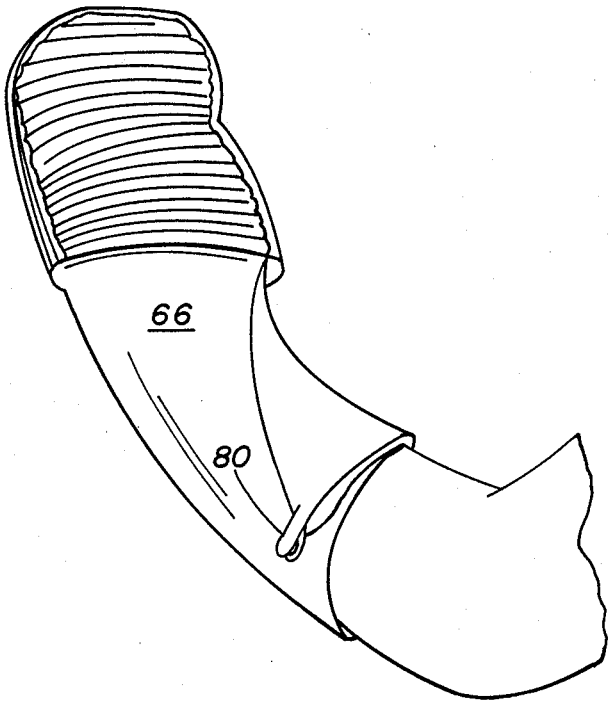
FIG. 17

ABSORBABLE CLEANING MITT FOR WIPING BABIES

CROSS-REFERENCE TO RELATED APPLICATION

This is a continuation-in-part application of application Ser. No. 193,259, filed on May 11, 1988, continuing, and application Ser. No. 224,431, filed on Jul. 26, 1988, continuing.

BACKGROUND OF THE INVENTION

The present invention is directed to an absorbable cleaning and wiping mitt or hand-insert pouch. The preferred use of the present invention is for wiping the buttocks, perineum, and pelvis areas of babies and toddlers from feces and urine, and may be used as well for other parts of the baby's body. Other uses of the present invention are for wiping clean bed-ridden patients, such as those suffering from Alzheimer's Disease, senile dementia, stroke, or any other debilitating disease or accident. Ancillary uses of the present invention are simple house-cleaning chores, such as dusting and furniture polishing, as well as any other application requiring wiping and absorption of liquids from surfaces. Presently-available products for wiping babies clean after a defecation or urination include disposable paper washcloths pre-moistened with a mixture of propylene-glycol and lanolin in a water base. These products, however, are not absorbent, and do not completely prevent the feces or urine from contacting the user's hand during wiping and cleaning. To better absorb feces, one must first use dry tissues or the like.

SUMMARY OF THE INVENTION

It is the primary objective of the present invention to provide an absorbable, hand-insertable mitt or pouch which is used to wipe and clean babies after defecation and urination in order to provide better absorption while also preventing contact of the user's hand with the waste products.

It is another objective of the present invention to provide such a pouch or mitt which is completely covers and protects the user's hand during such wiping and cleaning.

It is yet another objective of the present invention to provide such a mitt or pouch that ensures that no waste matter penetrates into the interior thereof, to ensure noncontact of the waster material with the user's hand.

It is still another objective of the present invention to provide such an absorbing and cleaning, hand-insertable mitt or pouch that may readily and easily converted to a waste-product bag or container storing the waste products for subsequent disposal in a garbage can, in a water closet, and the like.

Toward these and other ends, the hand-insertable, absorbable mitt or pouch is made of a plurality of layers or laminates defining a hollow interior closed at one end into which hollow interior a hand may be inserted and entirely enclosed. The mitt or pouch, in the preferred embodiment, includes four layers: A pair of water-repellent, water-proof soft plastic layers joined together along three edges and disconnected at one edge, by which the hollow interior of the pouch or mitt is formed for the insertion of a hand therein; an a pair of outer layers of absorptive material, such as cotton, each such absorptive layer being joined along three of its edges to the three edges of a respective inner layer of water-proof material, such that each inner layer of water-proof material is covered exteriorly by one such absorptive layer. In use, a user of the product simply inserts his or her hand into the hollow interior, and thereafter uses the outer absorptive layers by wiping and cleaning the buttocks and pelvis areas of a baby in order to wipe clean such areas after defecation and urination. The user first uses one outer absorptive layer, and when that is used up, he or she simply rotates the hand 180 degrees to use the other absorptive layer, to thereby wipe these areas clean of waste product. One of the outer absorptive layers may be pre-moistened with lanolin, and the like, for cleansing purposes, with the other absorptive layer providing the absorptive-drying thereafter. After the product of the present invention has been use, it is readily convertible into a disposable, waste-product container by simply everting, so that the water-repellent inner layers are positioned exteriorly, and the absorptive layers, with waste products thereon, are positioned interiorly, with the open end of the thus-formed disposable waste-product bag or container being closed off for subsequent disposal in a garbage can, water closet, and the like. In a modified form of the invention, only one outer absorptive layer is provided, with one inner of the two inner layers being exposed exteriorly, such an embodiment constituting a less costly alternative, which has especial relevance to new born infants where only one such outer absorptive layer is necessary, which modification is suitable not only for mothers but also for maternity wards of hospitals. The product of the present invention may also be used for cleaning and wiping bed-ridden patients and invalids. While in the preferred embodiment, the pouch or mitt is oblong-shape, or the like, and freed of any finger or thumb-insertions, it is possible to provide a thumb insertion in mitten-like fashion, or finger-insertions, in glove-like fashion, such offering greater flexibility during cleaning and wiping. In one embodiment, an interior or inner retaining ring or loop is provided for receiving a finger by which the product may be better stabilized during use, and by which eversion of the product after use is facilitated. In another embodiment, a projecting protective gauntlet is provided for extension along the forearm of the user, to protect the user from contact with contaminants. In yet another embodiment, the projecting skirt portion of the inner plastic layers is provided with a line of perforations extending most of the circumference of a lower portion of the skirt portion, by which the used and everted product may be tied and closed off, either alone or in conjunction with the inner retaining ring.

BRIEF DESCRIPTION OF THE DRAWING

The invention will be more readily understood with reference to the accompanying drawing, wherein:

FIGS. 14–17 are an isometric views of a modification of the invention

DETAILED DESCRIPTION OF THE INVENTION

Figure 1:
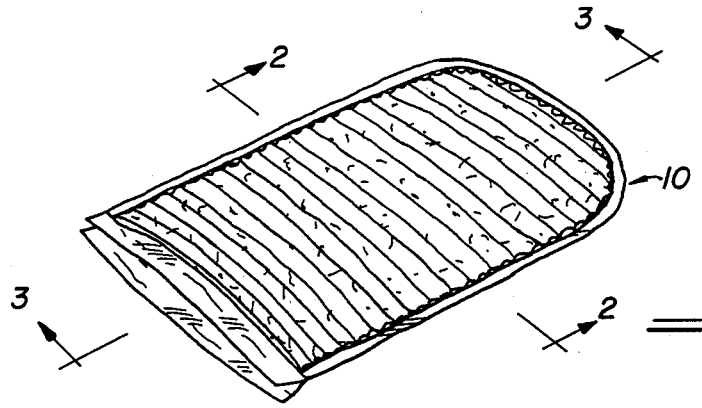
FIG. 1 is an isometric view of the baby cleaning mitt or pouch of the present invention where two outer absorptive layers are provided.
Figure 2:
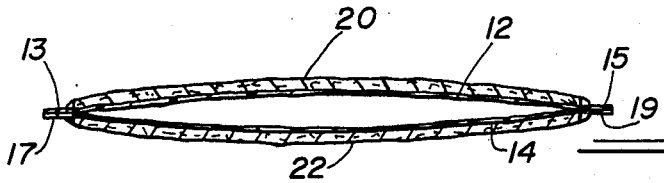
FIG. 2 is a cross-sectional view taken along line 2—2 of FIG. 1.
Figure 3:
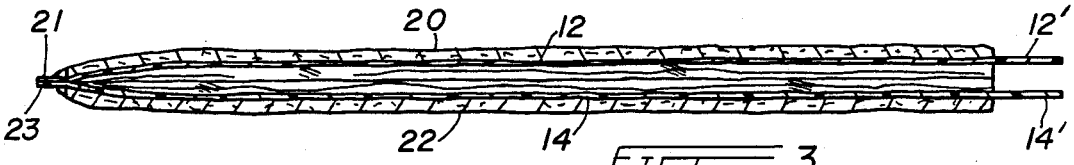
FIG. 3 is a cross-sectional view taken along line 3—3 of FIG. 1.

Referring now to the drawings in greater detail, the absorbale, hand-insertable cleaning mitt or pouch of the present invention is indicated generally by reference numeral 10, and is best seen in FIGS. 1–3. The product 10 of the invention, in the preferred embodiment, is made up of four layers. The first two layers are inner layers 12 and 14 made of thin, soft plastic film, such as polyproplyene, polyethylene, polyurethane film and the like, which layers are water-proof a water-repellent. These two layers are joined about three mutually corresponding edges thereof and are unconnected along one mutually corresponding edge 12′, 14′, the two inner layers defining therebetween a hollow interior volume into which is insertable a hand by which the product 10 may be used, the hand contacting the interior surfaces of the inner plastic-film layers for protection thereby against waste products, urine, liquids, etc., when using the product 10, as described below. Each inner plastic-film layer is overlaid with an exterior, moisture a liquid-absorbing layer 20, 22, respectively, of cotton, or cotton-polyester material, or other suitable moisture-absorbing material, such as absorbent paper, whereby the product 10 is a laminate. Each exterior layer 20, 22 is joined or united to its respective inner layer 12, 14 along three mutually-corresponding edges thereof, the three edges corresponding to the edges by which the two inner plastic-film layers are joined. The two inner layers are joined along the above-mentioned corresponding edges by the heat-sealing thereof, or by making the two inner layers from one unitary sheet of plastic film doubled over, with the one end edge of the doubled-over film sheet being heat-sealed, with the other edges thereof left open to define the open mouth of the product, to form the hollow interior volume, as described above. The two exterior layers of cotton are stitched, or otherwise joined, directly to each other along the three mutually-corresponding edges by such stitching, so that the two exterior layers sandwich therebetween the two inner layers of plastic-film, whereby the entire laminate becomes one unitary structure, the respective stitching also passing through the plastic-film inner layers whereby the laminate is fixedly formed. As is evident in FIG. 3, the edges 12′, 14′ of the inner layers project outwardly beyond the corresponding edges of the exterior absorption-layers, which projecting edges 12′, 14′ provide, firstly added protection for the hand to protect against waste products deposited on the exterior absorption-layers during the wiping of a baby, and, secondly, to provide an overhang by which the product 10, when everted after usage to form a disposable waste container or bag, by which the soiled exterior absorption-layers now become the inner layers, by which the used product 10 may be thrown away in a garbage can, water closet, and the like, as described below in greater detail. In the case of absorbent paper, or the like, for the outer layers, instead of stitching, all of the inner and outer layers may be secured together by conventional heat sealing the corresponding, juxtapositioned edges thereof. In the preferred form of the invention, the outer absorption-layers are made of a medical fabric, either Coform fabric, such as that manufactured by Kimberly-Clark Corp., or scrim reinforced tissue, having a basis weight of 2.07 oz./ square yard, and absorbent capacity of 515%, such as that also manufactured by Kimberly-Clark Corp., product number 2010/12.

Figure 4:
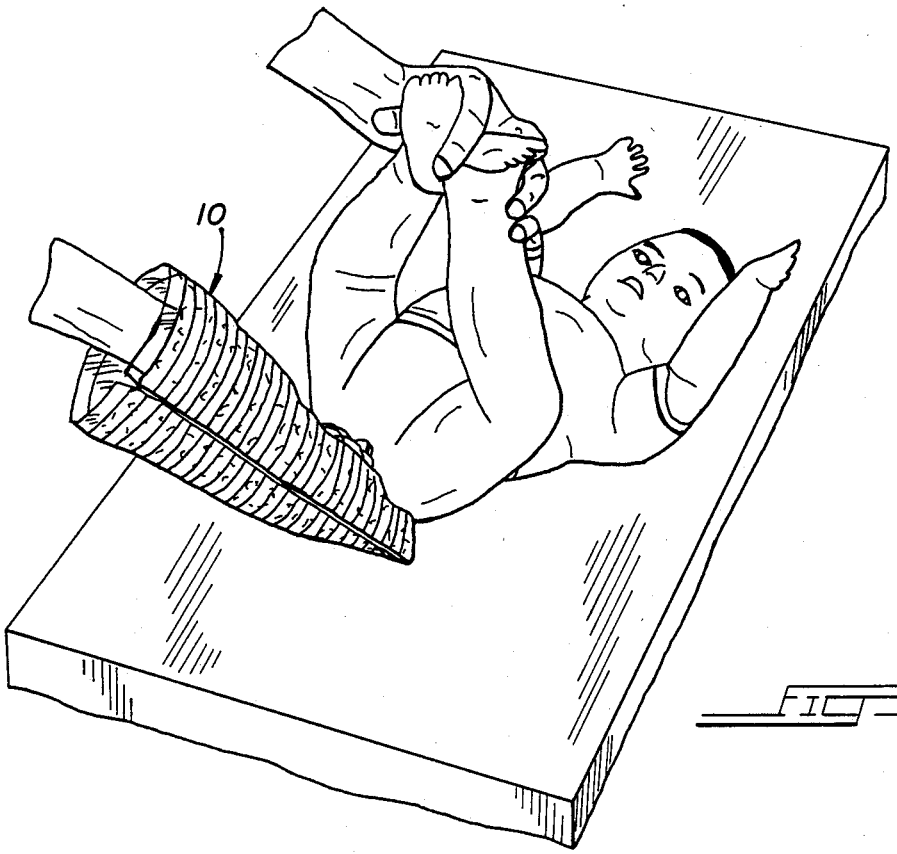
FIG. 4 is an isometric view showing the mitt or pouch of FIG. 1 in use for cleaning and wiping a baby of waste product.
Figure 5:
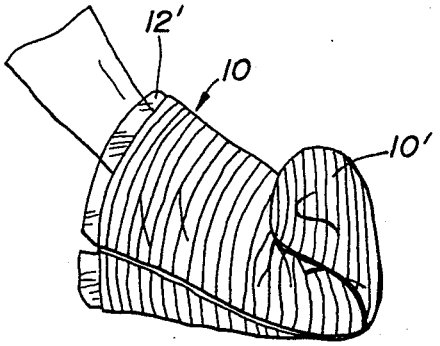
FIGS. 5–8 are isometric views, in sequential; order, showing the transformation of the thus-used product of FIG. 1 into a waste-product disposable storage container or bag for subsequent disposal in a garbage can, water closer, and the like, by the eversion of the layers thereof.
Figure 6:
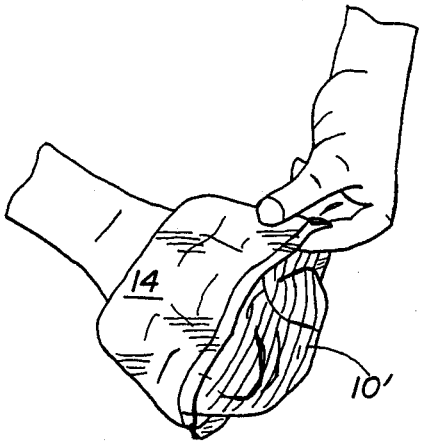
Figure 7:
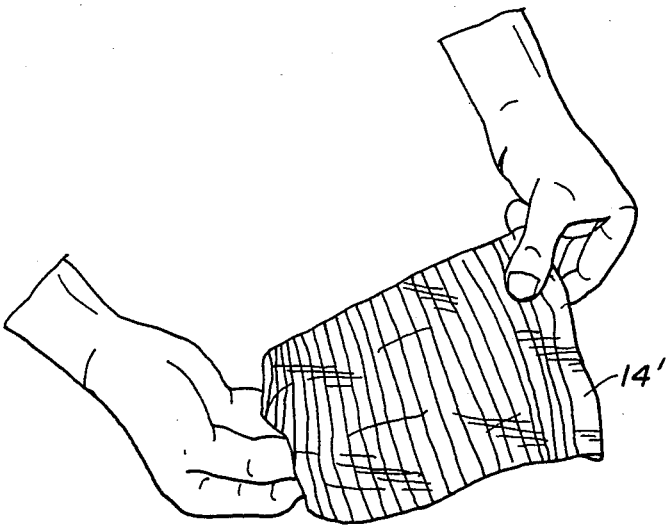
Figure 8:
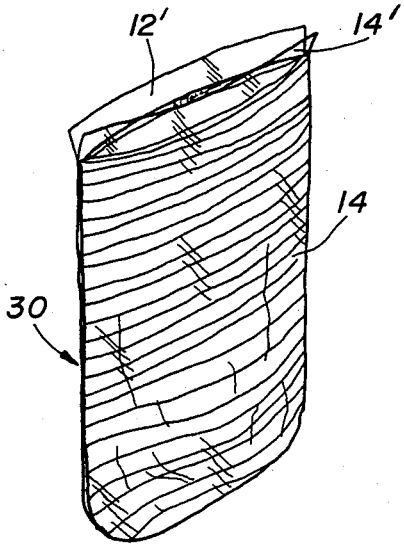
Figure 9:
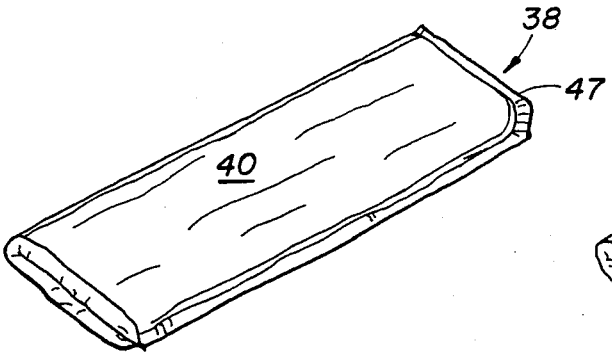
FIG. 9 is an isometric view showing the product of FIG. 1 of the present invention packaged for shipment and prior to use, which product of the present invention is closed off and sealed by an outer plastic wrapping layer.
Figure 10:
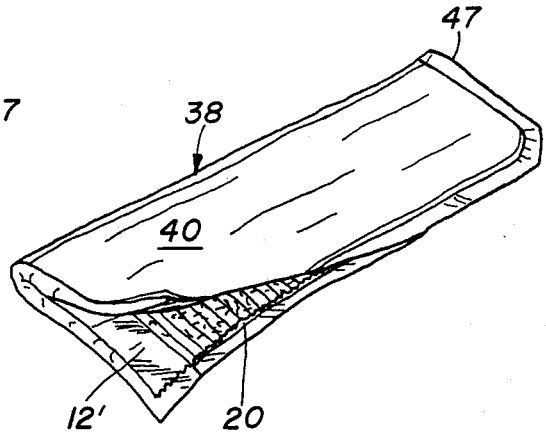
FIGS. 10–13 are isometric views, in sequential order, showing the steps employed in opening the wrapped and sealed package of FIG. 9 in order to expose the usable product of FIG. 1 of the present invention.

The product 10 is used in the manner shown in FIG. 4. The user places his or her hand in the interior volume between the two inner plastic-film layers 12, 14, with the two exterior, absorption-layers 20, 22 facing outwardly. Thereafter, the user wipes the baby clean by pressing one of the exterior layers 20, 22 against the buttocks area, or other area, of the baby, by which the waste products, urine, other liquid, and the like is absorbed by the exterior layer. When that exterior layer has become saturated, the user simply rotates his hand 180 degrees to exposes the other exterior absorption-layer against the area to be cleaned, and uses that layer until the job is completed or until it also becomes saturated. Instead of rotating the hand 180 degrees, it is possible to manipulate the product 10 so that is rotates 180 degrees relative to the hand, whereby that other exterior absorption-layer is juxtapositioned opposite the area to be cleaned, the hollow interior volume of the product 10 being of large enough volume so as to accomodate such procedure. The hand of the user is protected against the waste products, urine, or other liquid, since the hand only contacts the interior surfaces of the inner layers 12, 14, which are water-repellent and water-proof. When the cleaning and wiping procedure has been completed, or when the product 10 has become saturated, the product 10 is everted, or transposed, whereby the inner layers become the outer layers, and the exterior layers become the inner layers. This procedure is shown in FIGS. 5–8. FIG. 5 shows the hand in the interior volume right after the wiping and cleaning procedure. The user makes a fist, as shown in FIG. 5, and with his or her other hand, grasps one of edges 12′, 14′, and carefully pulls fisted hand toward the open mouth of the product 10, until the entire end 10′ of the product 10 is pulled through the open mouth, in the manner shown in FIGS. 6 and 7, until the inner film layers 12, 14 are positioned exteriorly, and the outer absorption layers 20, 22 are positioned interiorly, as shown in FIG. 8. In this everted state, the product 10 has now become a safe, disposable, waste-product container or bag 30, by which the waste products may be safely thrown away.

The product 10 may be provided with only one exterior absorption-layer of cotton. This would be advantageous for used in wiping and cleaning new-born infants, where two such exterior absorption-layers would be superfluous. The use of the product would still be the same as that described above, in that after use, the product is everted, in the same manner as shown in FIGS. 5–8. In this modification, the exterior layer is also attached, as by stitching, with the stitches after having passed through the exterior layer and two inner layers at the three mutually-corresponding edges thereof, being doubled-back on itself into the exterior layer again. Of course, it is within the scope and purview of the present invention to provide for any other type of fixed joinder of the layers of the laminate 10. It is also possible to provide one or both of the exterior absorption layers with a cleansing and soothing lotion, such as lanolin, or the like. It is also within the scope and purview of the present invention to provide a product 10 that is shaped like a mitten or glove, by the provision of one or more finger or thumb sleeve-insertions at the closed end opposite the mouth, by which greater flexibility and control of the cleaning and wiping process is achieved.

Figure 11:
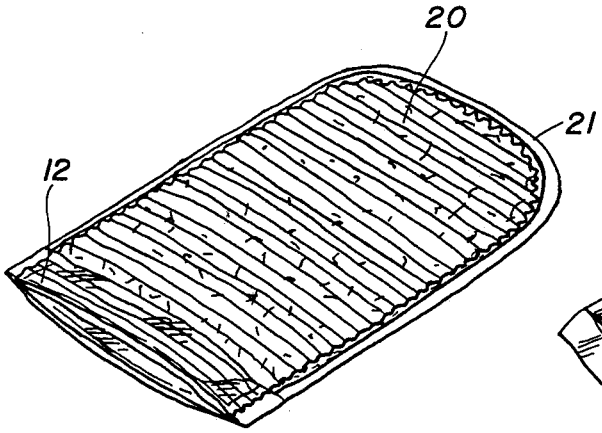
Figure 12:
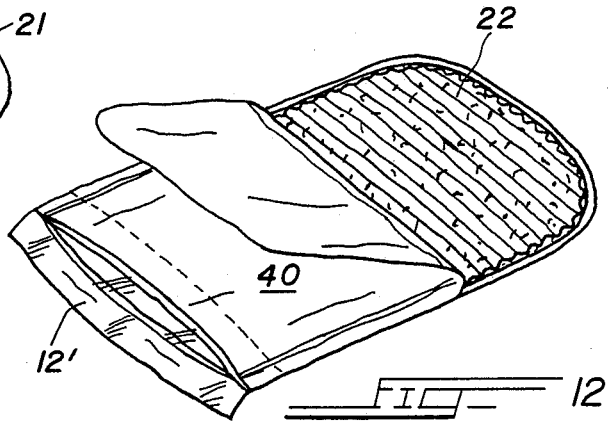
Figure 13:
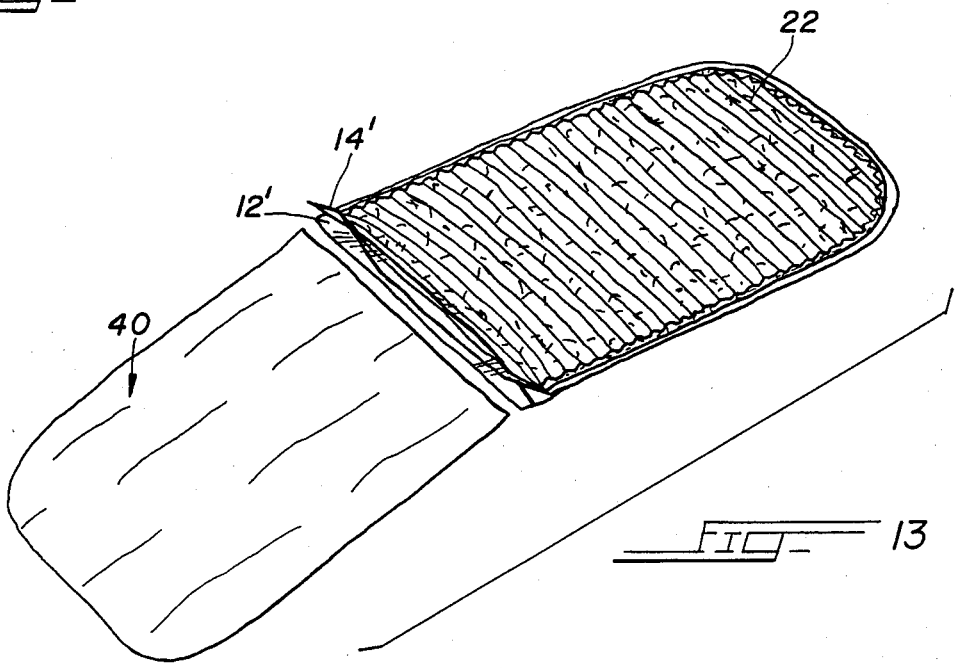

FIGS. 9–13 show the manner by which the product 10 is preferably packaged. The product 10 of FIG. 1 is doubled over along its longitudinal center line, with an outer protective layer 40 entirely surrounding the double-over product. This outer protective layer is preferably made of the same plastic film as the inner layers 12, 14, but of greater thickness, in order to form a neatly-packed and protected package 38. The outer protective layer 40 is joined to the three mutually-corresponding edges of the inner layers 12, 14 by heat-sealing, or the like, such being possible by making the width of each of the inner layers 12, 14 greater than the width of each of the exterior layers 20, 22, as clearly shown in FIG. 2, by which there is provided protruding longitudinal edges 13, 15 for the inner layer 12, and protruding longitudinal edges 17, 19 of inner layer 14. Thus, when the product 10 of FIG. 1 is folded or doubled over upon itself about its longitudinal center line, in the manner shown in FIG. 10, the edges 13, 15, 17, and 19 lie parallel and juxtapositioned one above the other, by which the protective outer film sheet 40 may be readily joined thereto by heat-sealing its own doubled-over longitudinal edges to the edges 15–19 of the product 10. The inner layers 12, 14 also define a protruding end-edges 21, 23, which form the closed end of the hollow interior volume of the product 10, but which also serve to allow joinder of an end-edge of the outer protective film thereto by heat-sealing, also, as shown by reference numeral 47 in FIGS. 9 and 10. The flap 12' under such packaging is tucked inside into the interior of the hollow volume, with the other flap 14' not as yet being formed, which flap 14' is formed after the package is opened and the outer protective layer 40 is cut to the length such that the flap 14' is left. The protective outer layer is severed from the inner plastic layers by any conventional means, and may even be achieved by tearing by hand. Referring to FIGS. 9–13, the stages of opening the package to form the product 10 of FIG. 1 is shown. The outer protective film 40 is severed or torn along one longitudinal edge thus exposing the flap 12' and the exterior absorption-layer 20. As the protective layer is severed at its edge 47, the entire package may then be folded open, as shown in FIG. 11, where the absorption-layer 20 is completely visible. The flap 12 has not as yet been folded outwardly. The end-edge 21 is visible. Thereafter, the package 38 is rotated 180 degrees, so that the protective layer 40, still joined along its longitudinal and end edges to the respective longitudinal and end edges of the inner layer 14, is visible, as shown in FIG. 12, and torn away from the edges of that inner layer, as shown in FIG. 12. Then, the layer 40 is finally severed from the inner layer 14, but severed such that the flap 14' is also formed thereby, as shown in FIG. 13.

FIGS. 14 and 15 show a modification 60 of the product of the invention. In order to aid in the eversion of the layers, there is provided a finger-gripping tab or insert 62 which defines a hole into which a finger may be inserted, so as to provide an anchoring point by which the product 60 may be more easily and readily everted after use, for subsequent disposal. Instead of gripping the interior end portion of the inner plastic layers, one may insert his or finger into the tab 62 and thereafter pull on the tab to accomplish the eversion, while the other, free hand grips the other end portions of the inner plastic film layers. The product 60 is also provided with a sleeve extension or gauntlet 66 formed by extending the inner plastic film layers to a much greater length than that shown in the embodiment of FIGS. 1–8. The length of such gauntlet is such so as to substantially enclose the forearm of a person using the product 60, so as to protect the forearm from any spillage of waste products and the like thereon. The apron 66 has especial use by nurses and paramedics for protecting them against contamination. The gauntlet may be made in tubular fashion as shown in FIGS. 14 and 15, with the respective portions of the two inner plastic film layers being heat-sealed at the mutually juxtaposition edges thereof to form such a tubular insert. The gauntlet is also preferably provided with a fastener on the remote end portion thereof, which fastener includes a male button element 78 affixed to one exterior surface portion of the remote end portion of the gauntlet 76, and a female element 80 defining a mating opening through which is snapped the button element 78, for securing the gauntlet about the forearm of a person, in the manner shown in FIG. 17. Of course, other fasteners may be used, such as hook-and-pile fasteners, and the like. Of course, the extended gauntlet 66 or the tab 62 may be provided together in the product of the invention, or separately.

It is also within the scope and purview of the present invention to make one of the outer layers of coarse material instead of absorptive material, so as to allow the product to be used for cleaning hard-to-clean objects, for polishing, and the like.

Figure 18:
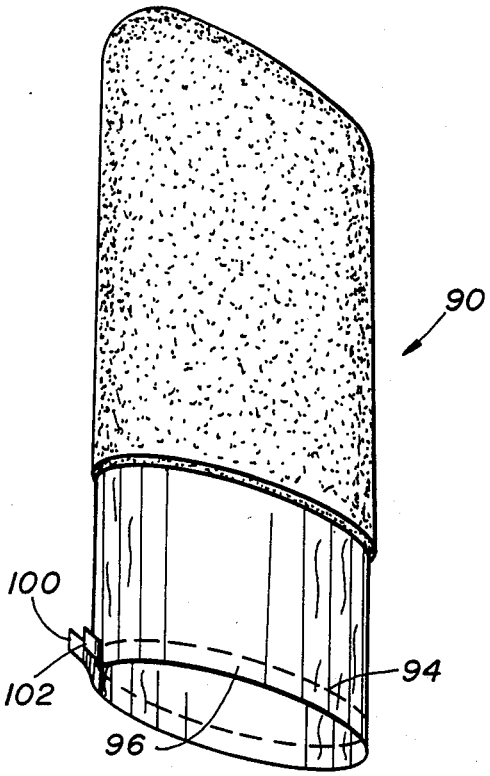
FIG. 18 is an isometric view of another embodiment of the invention where a tear-away strip is provided for use in closing off the everted, used product, with an inner gripping ring.
Figure 19:
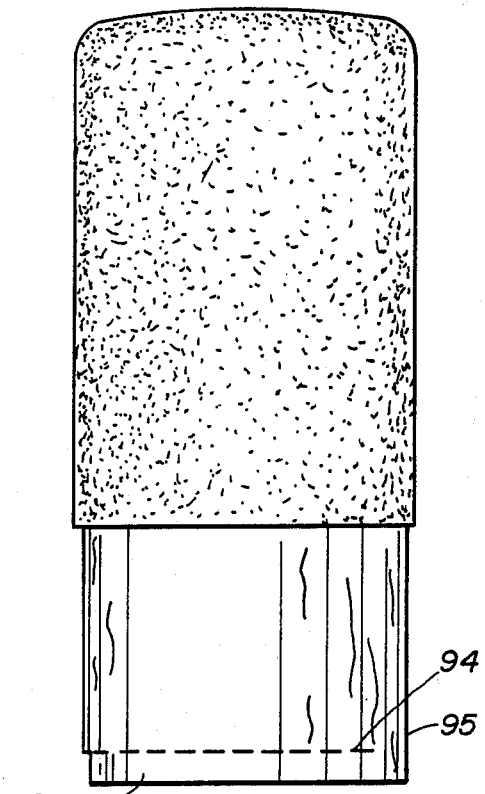
FIG. 19 is a front view thereof.
Figure 20:
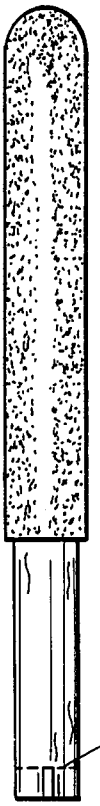
FIG. 20 is a first side view thereof.
Figure 21:
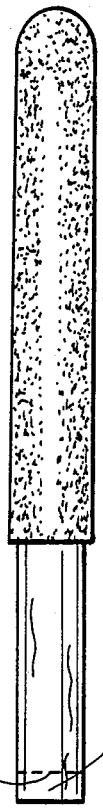
FIG. 21 is a second side view thereof.
Figure 22:
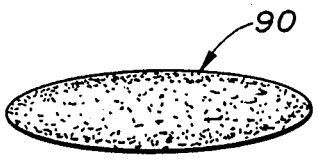
FIG. 22 is a top view thereof.
Figure 23:
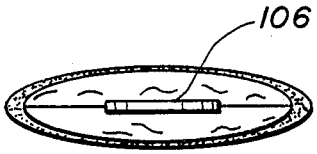
FIG. 23 is a bottom view thereof.
Figure 24:
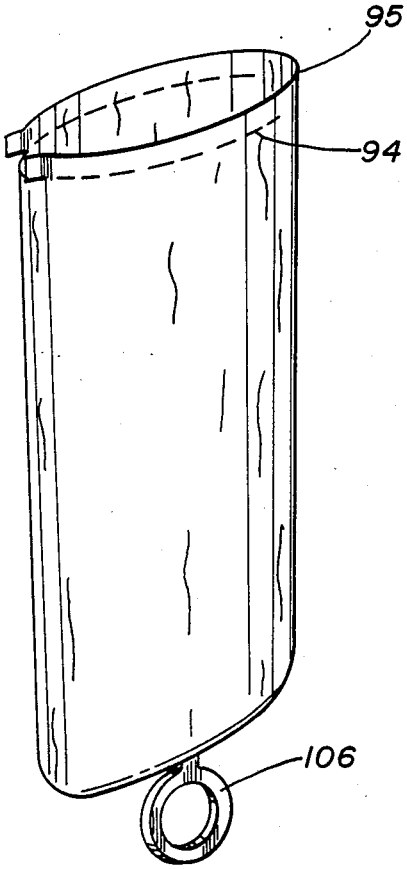
FIG. 24 is an isometric view showing the embodiment of FIGS. 18–23 in its everted state after use.

FIGS. 18–23 show another embodiment of the invention. The babywipe 90 is similar to the previous embodiments, with a projecting skirt 92 formed by extending the inner water-repellent plastic layers as compared with the embodiment of FIG. 1, such that the shape of the skirt 92 is substantially cylindrical when placed over the forearm of the person. The distal or rear end portion of the skirt 92 is provided with a line of perforations 94, which line extends about most of the circumference of the skirt end portion, as seen in FIGS. 18 and 24. There is a portion 95 of the lower skirt end portion that is free of these perforations, so that when the lower rim 96 of the skirt 92 is peeled back by pulling tabs 100, 102, such is terminated at the free portion 95. The thus-formed strip may thereafter be used for tying and closing off the open mouth of the skirt portion 92 after the product 90 has been used and everted. The product 90 also include an inner finger-receiving ring 106, as in the embodiment of FIG. 14. The ring 106 may be made of stiff plastic, or may even be made of soft flexible plastic, such as a loop, as long as a finger may inserted therein, in order to aid in the eversion of the product after use, as well as to retain the product on the hand during use in a stationary and relatively-fixed position, so as not to slide about or off the hand during wiping. When the product 90 is provided with such an inner retaining ring 106, after use and eversion of the product, the separated lower rim portion 96 may be inserted through the ring 106, now positioned exteriorly, in order to close off and tie the open mouth of the everted product, for subsequent safe and easy disposal, with little or no odor emanating. The tabs 100, 102 are formed during the manufacture of the product by making a transverse cut in the lower rim portion 96 of the skirt 92 up until a plane containing therein the line of perforations 94. When the product 90 is not provided with an inner ring 90, then the rim portion 96 is used alone to close off the everted product of FIG. 24. This is simply accomplished by pulling on the tabs 100, 102 and tearing along the line of perforations 94, and, thereafter, folding over the everted product such that the open top thereof lies folded over another portion of the everted product, and then the free strips of the rim portion tied thereabout. When the ring 106 is provided, the thus-tied open top of the everted bag may then be inserted or pushed through such ring 106 to help prevent the unraveling or opening of the thus-tied end. Thus, the retaining ring 106 serves a dual purpose.

The line of perforations may be used in other ways to close off the everted product. The two free strips may be wrapped about the product after the product has been folded over, one transverse section over another, or rolled up, after which the strips may be used for tying and retaining the product in its folded up or rolled up state. Alternatively, the free tie-strips may be first inserted through the retaining ring 106 and tied directly to the ring and/or then tied another portion of the everted product. It is also possible to provide only one continuous tie-strip rather than the two free ones above-described.

Figure 25:
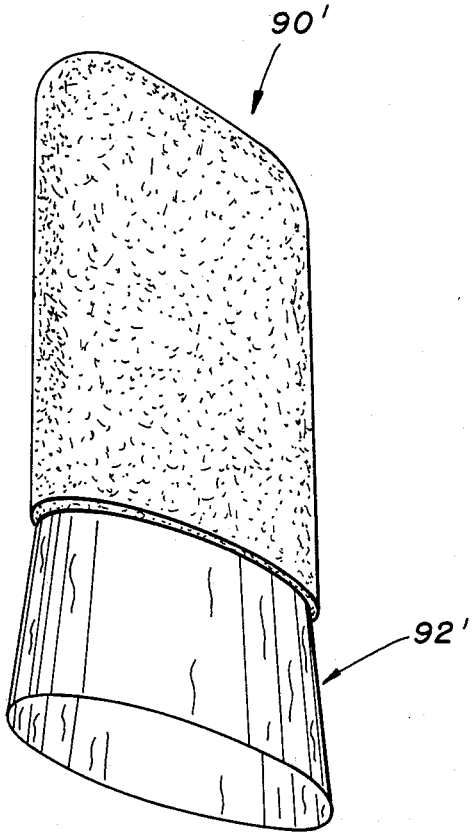
FIG. 25 is an isometric view of a modification of the invention where the extending skirt of the inner plastic layers is shaped frustro-conically to aid in the eversion of the product after use.

FIG. 25 shows a modification 90' of the skirt of the product, in that instead of a cylindrical skirt 92, there is provided a frustro-conical skirt portion 92', which defines an enlarged lower open mouth. This allows for a much easier eversion of the product after use, since the lower circumferential portion of the skirt may be gripped by the non-covered hand and thereafter pulled in the direction of the covered hand, to evert and remove the product. The product 90' may also be provided with an inner ring or loop 106, and with the line of perforations 94.

While specific embodiments of the invention have been shown and described, it is to be understood that numerous changes and modifications may be made therein without departing from the scope, spirit and intent of the invention as set forth in the appended claims.

What we claim is:

1. A baby-wipe for wiping and cleaning babies of waste products, and for use in cleaning and wiping invalids, and the like, comprising:

a first and a second layer of water-resistant, flexible material, each of said first and second layers defining a first and a second transverse end edge, and a first and a second longitudinal side edge; said first and second layers being joined together along at least a portion of each of said first end edges and said first and second side edges, and disconnected along at least a portion of each of said second end edges to form thereby a hollow interior volume having an open mouth allowing access therein for the insertion of a hand therein;

a third outer layer of soft, absorbable material having a first and a second transverse end edge, and a first and a second longitudinal side edge; said third outer layer being joined to said first layer along at least a portion thereof;

each of said first and second layers comprising a flap portion at a respective said second transverse end edge, each said flap portion projecting longitudinally outwardly beyond said second transverse end edge of said third layer to define a skirt portion, said skirt portion comprising a line of perforations about at least a lower circumferential portion thereof for use after everting said layers after wiping for tying and closing off the everted layers at the everted open mouth thereof; said line of perforations extending less then the full circumference of said lower circumferential portion of said skirt portion.

2. The baby-wipe according to claim 1, wherein said skirt portion comprises a lowermost rim portion defining two free strips after tearing along said line of perforations with an end of each said strip being joined to the section of said lower circumferential portion lacking the perforations.

3. The baby-wipe according to claim 1, further comprising a fourth outer layer of soft, absorbable material having a first and a second transverse end edge, and a first and a second longitudinal side edge; said fourth outer layer being joined to said second layer.

4. The baby-wipe according to claim 1, wherein said third outer layer is made of Coform medical fabric.

5. The baby-wipe according to claim 1, further comprising means connected to at least one of said first and second layers for gripping by a finger inserted within said hollow interior volume, said means for gripping being connected to an interior surface portion of said at least one layer.

6. The baby-wipe according to claim 5, wherein said means for gripping comprises a tab defining an opening for the reception therein of a portion of a finger of a hand inserted in said hollow interior volume.

7. The baby-wipe according to claim 5, wherein said means for gripping is connected to both to said first transverse end edges of said first and second layers.

8. The baby-wipe according to claim 1, wherein said skirt portion is substantially frustro-conical in shape defining an enlarged lower mouth end portion by which the non-covered hand of the person may grip said skirt portion to aid in the eversion and removal thereof from the covered hand.

9. The baby-wipe according to claim 2, wherein said lower rim portion comprises a pair of tab means for gripping by a hand in order to initiate the tearing of said lower rim portion along said line of perforations and for forming said two free strips.

10. The baby-wipe according to claim 9, wherein said two tab means are positioned approximately diametrically opposite said section of said lower circumferential portion of said skirt portion lacking perforations.

11. The baby-wipe according to claim 10, wherein said skirt portion is substantially frustro-conical in shape defining an enlarged lower mouth end portion by which the non-covered hand of the person may grip said skirt portion to aid in the eversion and removal thereof from the covered hand.

12. The baby-wipe according to claim 10, further comprising means connected to at least one of said first and second layers for gripping by a finger inserted within said hollow interior volume, said means for gripping being connected to an interior surface portion of said at least one layer.

13. A method of using a baby-wipe for wiping and cleaning babies of waste products, and for use in cleaning and wiping invalids, and the like, said baby-wipe comprising a first and a second layer of water-resistant, flexible material defining a hollow interior volume having an open mouth allowing access therein for the insertion of a hand therein, and a third outer layer of soft, absorbable material joined to said first layer along at least a portion thereof, whereby the user may insert a hand therein, and wipe a baby clean using the outer layer of soft, absorbent material, with the user's hand remaining dry and free of waste product wiped via said water-resistant first and second layers, each of said first and second layers comprising a flap portion at a respective second transverse end edge, each flap portion projecting longitudinally outwardly beyond the corresponding transverse end edge of said third layer to define a skirt portion, said skirt portion comprising a line of perforations about at least a circumferential portion thereof for use after everting said layers after wiping for tying and closing off the everted layers at the everted open mouth thereof, said method comprising:

(a) everting said layers after wiping;

(b) tearing away a lower rim section of the of the skirt portion from the line of perforations, the lower rim section being below and directly adjacent to the line of perforations;

(c) thereafter, tying the torn away part of the lower rim about of a portion of the rest of the product, for closing off the everted product for subsequent disposal;

(d) folding over the everted skirt portion before said step (c) such that the circumferential part of the lower rim is juxtapositioned over a different portion of the skirt portion, and, thereafter, performing said step (c) peripherally about said folded over skirt portion.

14. The method according to claim 13, wherein said step (b) comprises tearing away the circumferential part of the lower rim section in two strips, one strip in the clockwise direction, and the other strip in the counterclockwise direction.

15. The method according to claim 13, further comprising: (e) inserting the torn-away circumferential part of the lower rim through a ring connected to an interior portion of at least one of the first and second layers, the ring being positioned exteriorly after said step step (a).

16. The method according to claim 15, wherein said step (e) is performed after said step (d), and said step (e) comprises inserting part of the closed off skirt portion through the ring for helping to retain the closed off everted mouth in its closed state.

* * * * *